US010967670B2

(12) United States Patent
Wong

(10) Patent No.: US 10,967,670 B2
(45) Date of Patent: Apr. 6, 2021

(54) ORNAMENT ASSEMBLY WITH SUSPENSION EFFECT

(71) Applicant: TAT ROY JEWELLERY LIMITED, Hong Kong (CN)

(72) Inventor: Shek Shun Wong, Hong Kong (CN)

(73) Assignee: TAT ROY JEWELLERY LIMITED, Hong Kong (CN)

( * ) Notice: Subject to any disclaimer, the term of this patent is extended or adjusted under 35 U.S.C. 154(b) by 359 days.

(21) Appl. No.: 15/601,510

(22) Filed: May 22, 2017

(65) Prior Publication Data

US 2018/0332931 A1 Nov. 22, 2018

(30) Foreign Application Priority Data

May 19, 2017 (CN) ..... 17105123.0

(51) Int. Cl.

| | |
|---|---|
| ***A44C 17/00*** | (2006.01) |
| ***A44C 25/00*** | (2006.01) |
| ***B44C 5/00*** | (2006.01) |
| *A44C 17/02* | (2006.01) |

(52) U.S. Cl.

CPC ..... *B44C 5/005* (2013.01); *A44C 17/0291* (2013.01); *A44C 25/002* (2013.01); *A44D 2203/00* (2013.01)

(58) Field of Classification Search

CPC ..... A44C 25/002; A44C 17/0283; A44C 17/0291; B44C 5/005; A44D 2203/00

USPC ..... 63/900

See application file for complete search history.

(56) References Cited

U.S. PATENT DOCUMENTS

| | | | | |
|---|---|---|---|---|
| 2,323,837 | A * | 7/1943 | Neal | G09F 19/10 434/134 |
| 4,578,044 | A * | 3/1986 | Saitoh | A63H 33/26 446/134 |
| 5,188,555 | A * | 2/1993 | Zbegner | A63H 33/26 273/443 |
| 5,913,707 | A * | 6/1999 | Roman | A63H 33/26 428/16 |
| 6,413,138 | B1 * | 7/2002 | Dokoupil | A63H 33/26 446/129 |
| 6,766,658 | B2 * | 7/2004 | Scharf | A44C 17/02 63/26 |
| 6,851,279 | B2 * | 2/2005 | Hartgrove | A44C 9/003 63/29.1 |
| 7,671,712 | B2 * | 3/2010 | Elliott | H01F 7/0236 335/306 |

(Continued)

*Primary Examiner* — Jack W Lavinder

(74) *Attorney, Agent, or Firm* — Muncy, Geissler, Olds & Lowe, P.C.

(57) ABSTRACT

An ornament assembly with a suspension effect, including a base having a bottom frame and a transparent bottom cover, the transparent bottom cover being fixed on the bottom frame; a top frame fit combined with the base to form an integral body, wherein a transparent top cover is fixed on the top frame and the top cover is fit with the transparent bottom cover to form a holding space; a first magnetic member provided on the base; and an ornament, wherein a second magnetic member is provided on the ornament. The ornament is provided in the holding space and magnetic poles of the first magnetic member and the second magnetic member are oppositely arranged such that the ornament is suspended in the holding space under the repulsive force of magnetic forces.

7 Claims, 7 Drawing Sheets

(56) References Cited

U.S. PATENT DOCUMENTS

| | | | | |
|---|---|---|---|---|
| 8,096,145 | B2 * | 1/2012 | Corvino | A44C 17/0241 63/15 |
| 8,717,129 | B1 * | 5/2014 | Cash | H01F 7/0236 335/306 |
| 8,803,646 | B2 * | 8/2014 | Farber | H01F 7/00 335/306 |
| 8,991,210 | B1 * | 3/2015 | Stewart, Jr. | A44C 7/003 63/12 |
| 9,398,792 | B2 * | 7/2016 | Liao | A44C 25/00 |
| 10,065,081 | B1 * | 9/2018 | McKiernan | A63B 69/0075 |
| 2003/0176144 | A1 * | 9/2003 | Fisher | A63H 33/26 446/133 |
| 2006/0044094 | A1 * | 3/2006 | Davis | B60L 13/04 335/220 |
| 2007/0084241 | A1 * | 4/2007 | Kretchmer | A44C 25/00 63/29.2 |
| 2007/0234757 | A1 * | 10/2007 | Sherman | A44C 25/002 63/18 |
| 2009/0280272 | A1 * | 11/2009 | Faanes | B44C 5/005 428/14 |
| 2012/0066872 | A1 * | 3/2012 | Eisenberger | F16B 1/00 24/303 |

* cited by examiner

ORNAMENT ASSEMBLY WITH SUSPENSION EFFECT

FIELD OF THE UTILITY MODEL

The present utility model relates to the technical field of ornaments put on human body, in particular to an ornament assembly with a suspension effect achieved by virtue of magnetic forces.

BACKGROUND OF THE UTILITY MODEL

Ornaments are indispensable articles for modern people, especially modern females. With the improvement of the living standard of people, the requirements on ornaments become higher and higher, and not only are the ornaments required to have delicate and attractive appearance, but also the ornaments are required to be capable of presenting different changes and effects.

Jewelry manufacturers manufacture various ornaments such as happy diamond series jewelries and watches in order to cater to the taste of the public. Diamonds in this series of products can be shaken to move in jewelries or watches, the diamonds are enabled to slip the leash of the traditional inlaying technology, the single effect of the existing products is improved, new creativity is produced and people feel inspired.

Obviously, the diamonds in the above-mentioned products can only be shaken to move in crystal planes, and the ornaments themselves still lack for attractive effects and cannot satisfy the pursuit of modern people for the sense of beauty of ornaments.

SUMMARY OF THE UTILITY MODEL

In order to solve the above-mentioned problem, the main purpose of the present utility model is to provide an ornament assembly which is more beautiful than the existing ornaments, has a suspension effect without adopting any mechanical connection, is simple and attractive and successfully caters to the taste of the public.

In order to realize the above-mentioned purpose, the present utility model adopts the following technical solution:

An ornament assembly with a suspension effect comprises:

a base comprising a bottom frame and a transparent bottom cover, wherein the transparent bottom cover is fixed on the bottom frame;

a top frame fit and combined with the base to form an integral body, wherein a transparent top cover is fixed on the top frame and the top cover is fit with the transparent bottom cover to form a holding space;

a first magnetic member provided on the base; and an ornament, wherein a second magnetic member is provided on the ornament, the ornament is provided in the holding space and magnetic poles of the first magnetic member and the second magnetic member are oppositely arranged such that the ornament is suspended in the holding space under a repulsive force of magnetic forces.

Further, according to the present utility model, the bottom frame comprises:

a bottom outer frame provided in the bottom frame; and a bottom inner frame provided in the bottom outer frame and combined with the bottom outer frame.

Further, according to the present utility model, the transparent bottom cover is inlaid between the bottom outer frame and the bottom inner frame.

According to the ornament assembly with the suspension effect provided by the present utility model, the first magnetic member is provided at one end of the bottom frame.

According to the ornament assembly with the suspension effect provided by the present utility model, the first magnetic member is fixed at one end of the bottom frame, wherein the first magnetic member is configured to account for 40-60% such as 50% of a circumference of the entire bottom frame.

According to the ornament assembly with the suspension effect provided by the present utility model, the top frame comprises a top outer frame and a top inner frame which are mutually combined.

Further, according to the ornament assembly with the suspension effect provided by the present utility model, the transparent top cover is inlaid between the top outer frame and the top inner frame.

Further, according to the ornament assembly with the suspension effect provided by the present utility model, the number of the second magnetic members on the ornament is at least more than one, e.g. four; and the number of the second magnetic members is selected according to the size and weight of the ornament, so as to guarantee that there is enough magnetic force to support the ornament.

According to the ornament assembly with the suspension effect provided by the present utility model, the transparent bottom cover and the transparent top cover are made of crystal glass, wherein the thickness of the transparent bottom cover and the transparent top cover is 1-2 mm.

Preferably, the first magnetic member and the second magnetic member are magnetic stones and magnets.

Preferably, the bottom outer frame, the bottom inner frame, the top outer frame and the top inner frame in the ornament assembly with the suspension effect provided by the present utility model are all bonded together by using waterproof glue, such that the entire product has a waterproof effect.

To sum up, according to the ornament assembly with the suspension effect provided by the present utility model, the two magnetic members are oppositely provided to produce a repulsive force by adopting magnetic forces of magnetic stones and magnets, the ornament connected with the magnetic member can be suspended in the space between the transparent bottom cover and the top cover without using any mechanical mechanism, and thereby the suspension effect is achieved.

Besides, different patterns may also be provided on the bottom cover and the top cover, such that the suspension effect is better and is capable of presenting different changes with different patterns.

The ornament assembly with the suspension effect provided by the present utility model has the waterproof effect, the ornament can be prevented from being eroded by water mist and the service life of the ornament is prolonged.

The ornament assembly with the suspension effect provided by the present utility model is unique in creativity, the entire product structure is not complex and the ornament assembly can be easily accepted by the public.

BRIEF DESCRIPTION OF THE DRAWINGS

The mechanism of the present utility model will be further described below in details in combination with the embodiments with reference to the drawings, in which.

DETAILED DESCRIPTION OF THE EMBODIMENTS

A structure of an ornament assembly with a suspension effect provided by the present utility model will be described in detail through the following embodiments.

Figure 1:
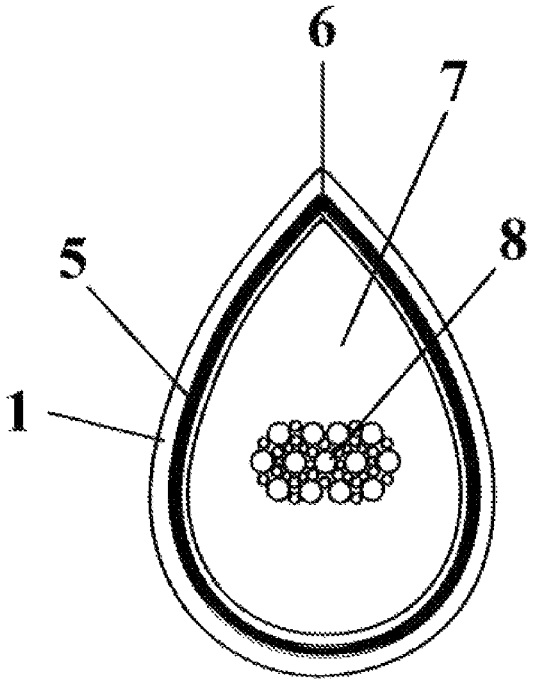
FIG. 1 illustrates a front schematic view of an ornament assembly with a suspension effect according to one embodiment of the present utility model.
Figure 2:
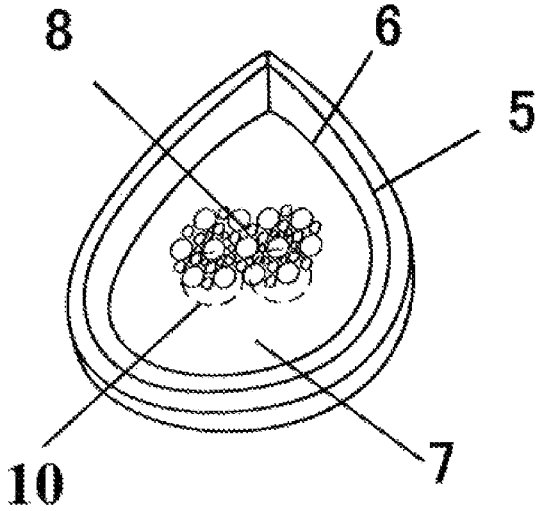
FIG. 2 illustrates a front schematic perspective view of an ornament assembly with a suspension effect according to one embodiment of the present utility model.
Figure 3:
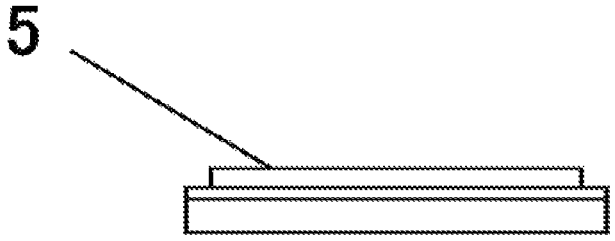
FIG. 3 illustrates a top view of an ornament assembly with a suspension effect according to one embodiment of the present utility model.
Figure 4:
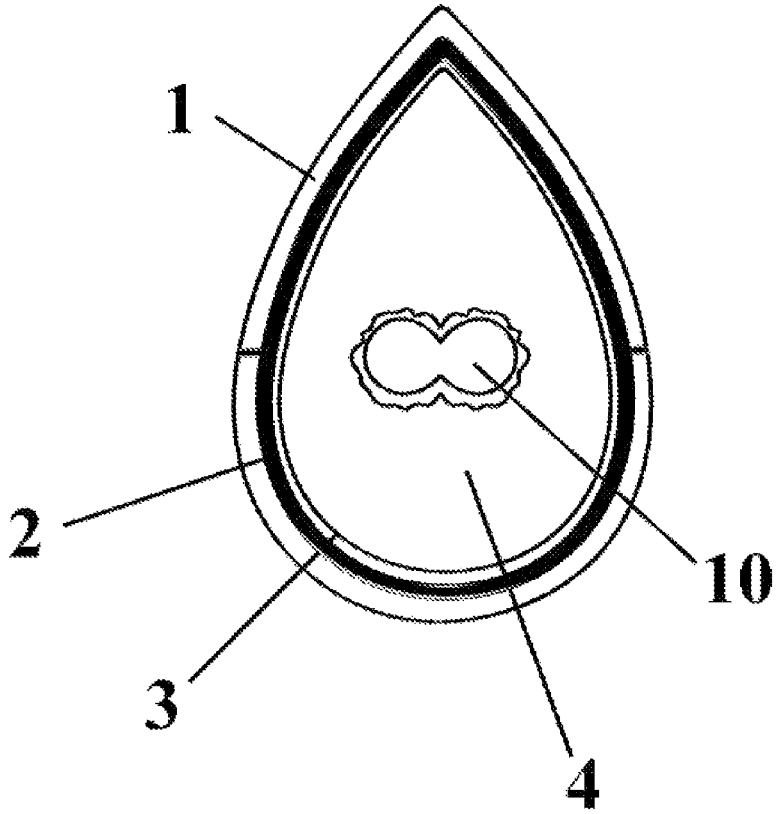
FIG. 4 illustrates a rear schematic view of an ornament assembly with a suspension effect according to one embodiment of the present utility model.
Figure 5:
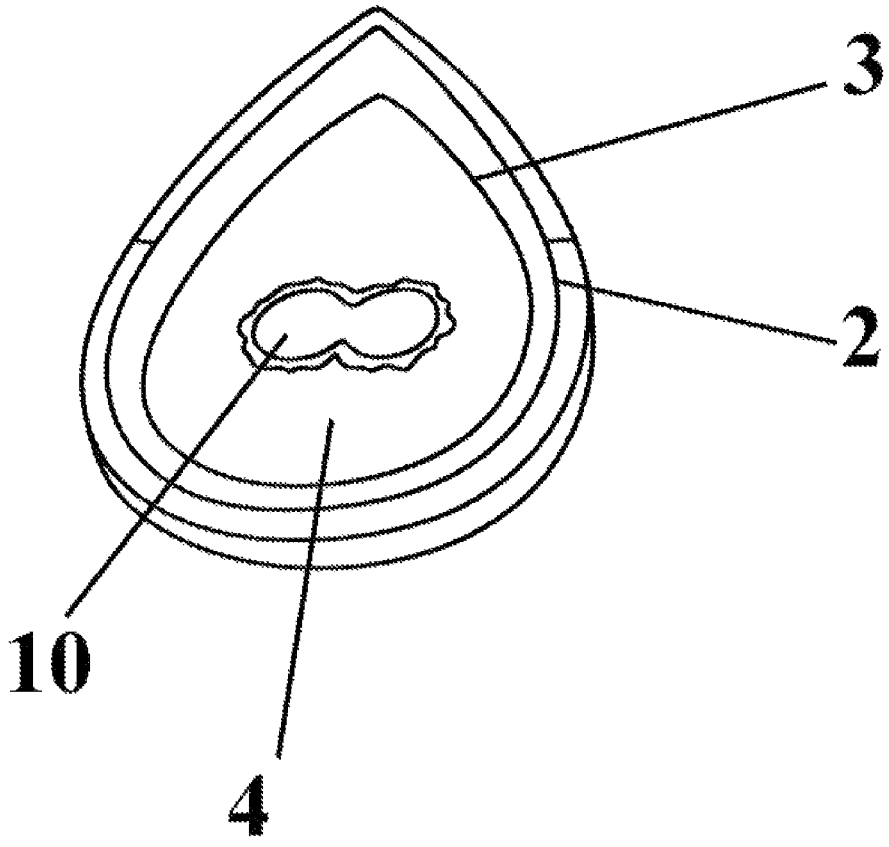
FIG. 5 illustrates a rear schematic perspective view of an ornament assembly with a suspension effect according to one embodiment of the present utility model.
Figure 6:
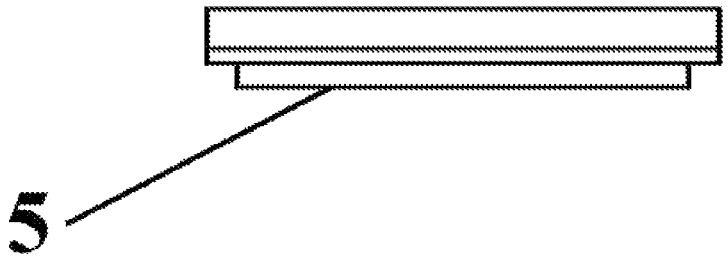
FIG. 6 illustrates a bottom view of an ornament assembly with a suspension effect according to one embodiment of the present utility model.
Figure 13:
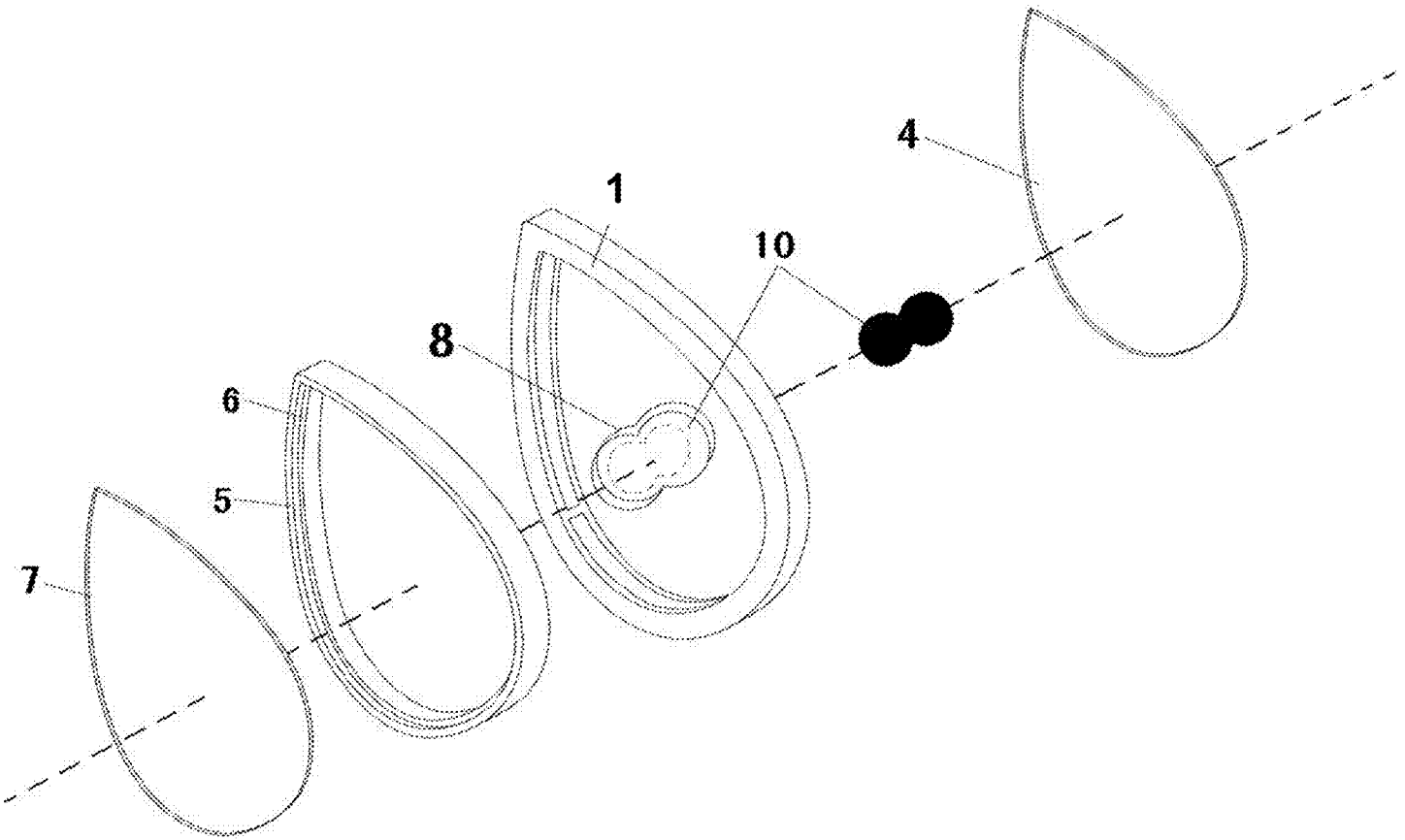
FIG. 13 illustrates an exploded view of an ornament assembly with a suspension effect according to the embodiment of FIGS. 1-6.

FIG. 1 to FIG. 6 and FIG. 13 illustrate one embodiment of an ornament assembly with a suspension effect provided by the present utility model. In this embodiment, the ornament assembly with the suspension effect comprises a base and a top frame which are combined to form an integral body. The base comprises a bottom frame 1 and a transparent bottom cover 4, wherein the transparent bottom cover 4 is fixed on the bottom frame 1. Further, according to the present utility model, the bottom frame 1 is made of metal, the bottom frame 1 comprises a bottom outer frame 2 provided in the bottom frame 1 and a bottom inner frame 3 provided in the bottom outer frame 2, wherein the bottom inner frame 3 and the bottom outer frame 2 are combined together.

Further, the transparent bottom cover 4 is inlaid between the bottom outer frame 2 and the bottom inner frame 3. In one embodiment, the transparent bottom cover 4 is made of crystal glass, and the thickness of the transparent bottom cover 4 is 1-2 mm such as 1.8 mm.

The bottom frame 1 may be manufactured to be in different shapes, such as square shape, rectangular shape, heart shape, circular shape, elliptical shape, pentagonal shape, hexagonal shape, octagonal shape or rhombic shape, so as to satisfy diversified aesthetic demands and needs. In this embodiment, the bottom frame 1 is designed to be in a heart shape.

Based on the shape of the bottom frame 1, shapes of all other parts such as the shapes of the bottom outer frame 2 and the bottom inner frame 3 and the shape of the top frame are designed to be fit with it.

The ornament assembly with the suspension effect comprises a top frame fit and combined with the base to form an integral body, a transparent top cover 7 is fixed on the top frame and the transparent top cover 7 is fit with the transparent bottom cover 4 to form a holding space. In one embodiment, the top frame comprises a top outer frame 5 and a top inner frame 6 which are mutually combined, wherein the transparent top cover 7 is inlaid between the top outer frame 5 and the top inner frame 6. In one embodiment, the transparent top cover 7 is made of crystal glass, wherein the thickness of the transparent top cover 7 is 1-2 mm such as 1.5 mm.

The ornament assembly with the suspension effect comprises a first magnetic member 9 provided on the base. Specifically, the first magnetic member 9 is fixed at the bottom frame 1. In order to keep enough magnetic force, the first magnetic member 9 should have enough length. Preferably, the first magnetic member 9 is configured to account for 40-60% such as 50% of a circumference of the entire bottom frame 1, such that the magnetic force of the first magnetic member 9 can produce enough magnetic force.

The ornament assembly with the suspension effect comprises an ornament 8 such as a gold ornament or a jewelry diamond, a second magnetic member 10 is provided on the ornament 8, and the ornament 8 is provided in the holding space formed by the transparent bottom cover 4 and the transparent top cover 7. Herein, magnetic poles of the first magnetic member 9 and the second magnetic member 10 are oppositely arranged such that the ornament 8 is suspended in the holding space under a repulsive force of magnetic forces.

Further, enough second magnetic members 10 are selected according to the size and weight of the ornament 8, so as to guarantee that the magnetic force is enough to attract the ornament and corresponds to the repulsive force produced by the first magnetic member 9. According to one embodiment of the ornament assembly with the suspension effect provided by the present utility model, the number of the second magnetic members 10 on the ornament 8 is at least more than one, e.g. four.

Preferably, the first magnetic member 9 and the second magnetic member 10 are all magnetic stones and magnets. Or, the magnetic members are other components having the same effect.

Preferably, the bottom outer frame 2, the bottom inner frame 3, the top outer frame 5 and the top inner frame 6 in the ornament assembly with the suspension effect provided by the present utility model are all bonded together by using waterproof glue, such that the entire product has a waterproof effect.

Figure 7:
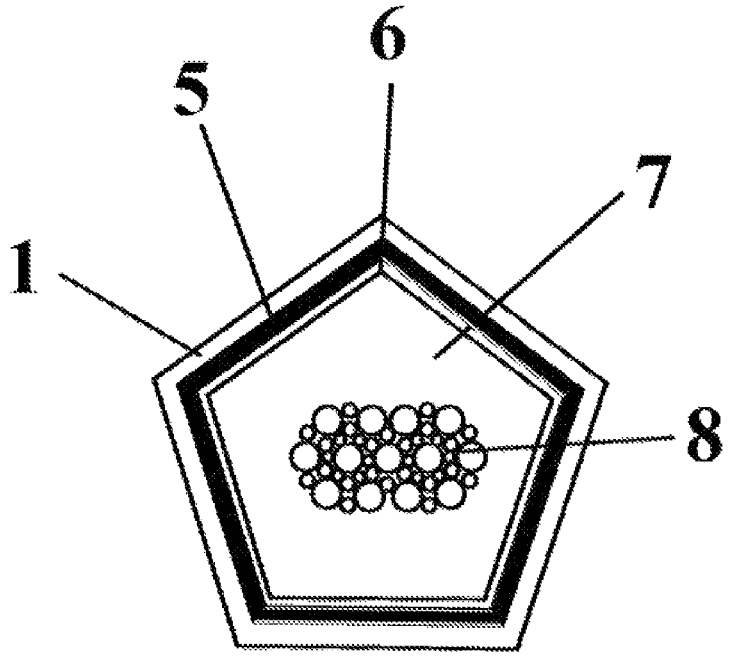
FIG. 7 illustrates a front schematic view of an ornament assembly with a suspension effect according to another embodiment of the present utility model.
Figure 8:
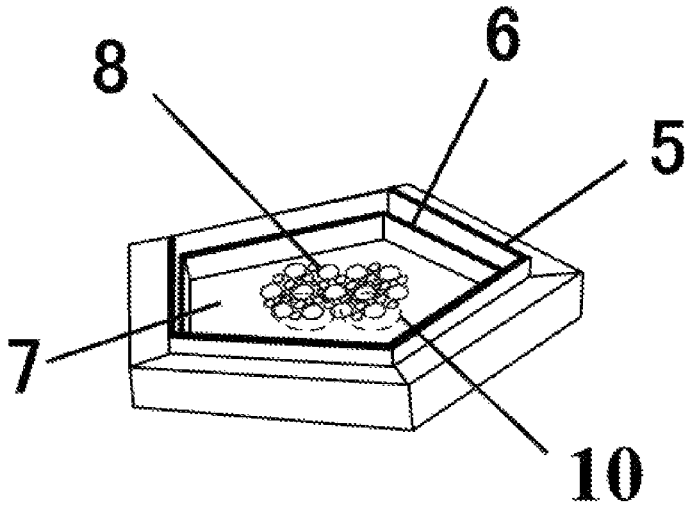
FIG. 8 illustrates a front schematic perspective view of an ornament assembly with a suspension effect according to another embodiment of the present utility model.
Figure 9:
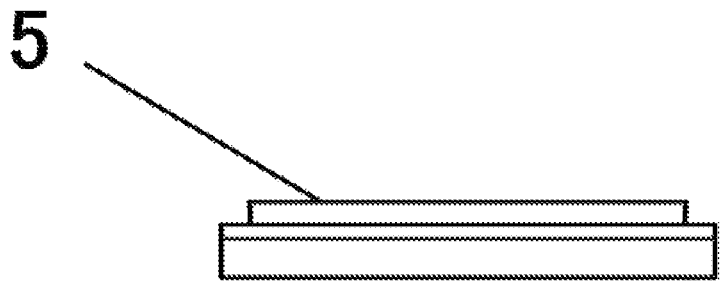
FIG. 9 illustrates a top view of an ornament assembly with a suspension effect according to another embodiment of the present utility model.
Figure 10:
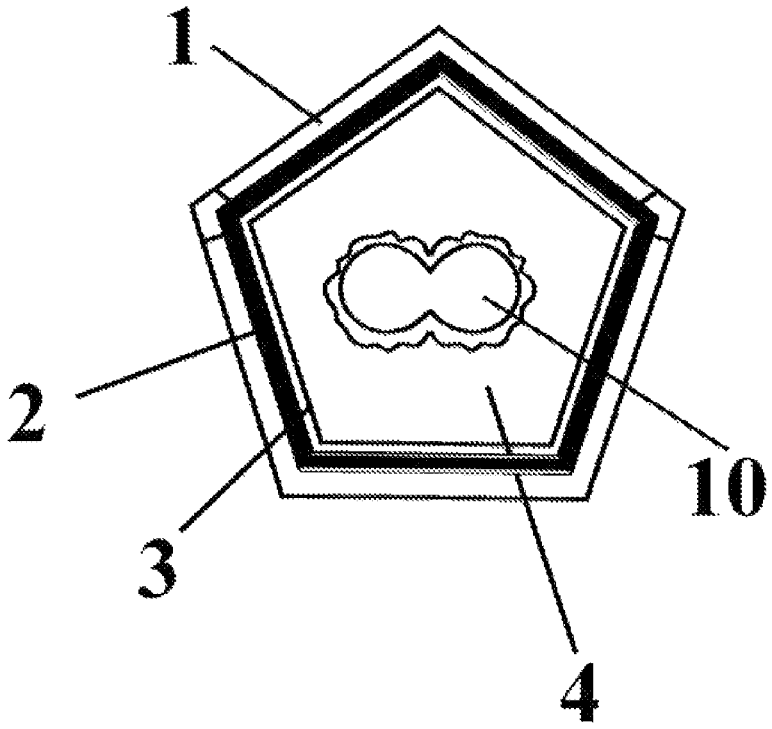
FIG. 10 illustrates a rear schematic view of an ornament assembly with a suspension effect according to another embodiment of the present utility model.
Figure 11:
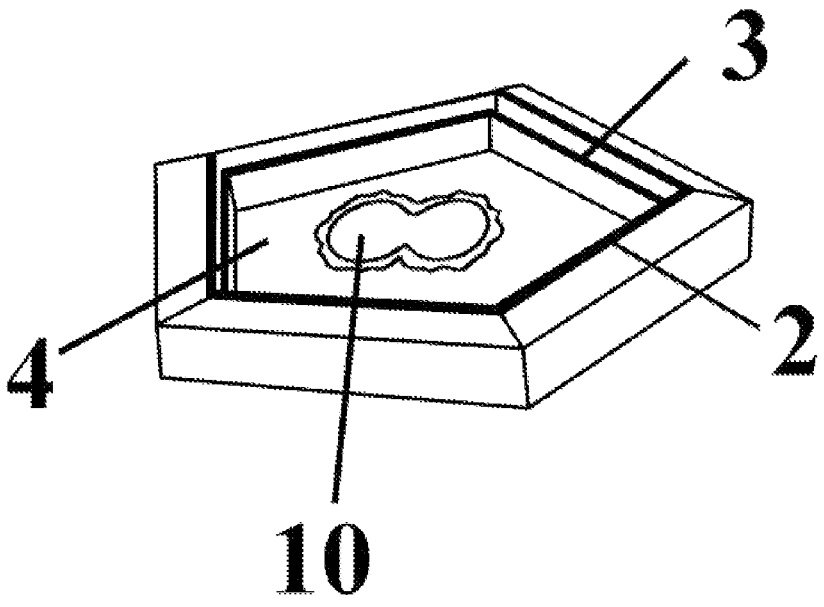
FIG. 11 illustrates a rear schematic perspective view of an ornament assembly with a suspension effect according to another embodiment of the present utility model.
Figure 12:
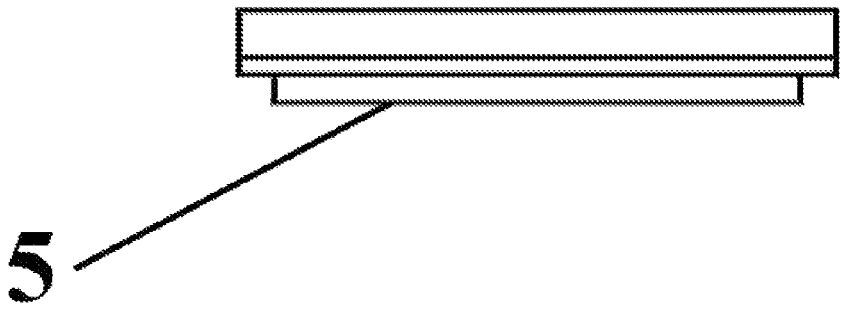
FIG. 12 illustrates a bottom view of an ornament assembly with a suspension effect according to another embodiment of the present utility model.

FIG. 7 to FIG. 12 illustrate another embodiment of an ornament assembly with a suspension effect provided by the present utility model. In this embodiment, all components are unchanged and the bottom frame 1 is designed to be in a pentagonal shape, such that the entire product produces different visual effects.

Further, different patterns may be provided on the transparent bottom cover 4 and the transparent top cover 7 such that the patterns are overlapped with the suspension effect and the entire product is more attractive.

When the product provided by the present utility model is manufactured, firstly the shape of the product needs to be determined and all needed components are prepared. Starting from the metallic bottom frame 1, the crystal glass bottom cover 4 is now bonded at the bottom outer frame 2 and the bottom inner frame 3 using waterproof glue, and then the first magnetic member 9 is fixed at the metallic bottom frame 1.

Then, the second magnetic members 10 are mounted on the ornament 8, wherein the second magnetic members 10 may also be bonded on the ornament 8 using glue.

Finally, the front side of the ornament 8 on which the second magnetic members 10 are successfully bonded at the bottom of the ornament is placed on the front side of the crystal glass bottom cover 4 at the metallic bottom frame 1, and then the crystal glass top cover 7 is bonded at the top outer frame 5 and the top inner frame 6. Thereby, the ornament 8 is clamped between the two crystal glass covers and the manufacture of the entire product is completed.

Besides, different patterns may also be provided on the bottom cover and the top cover, such that the suspension effect is better and is capable of presenting different changes with different patterns.

To sum up, according to the ornament assembly with the suspension effect provided by the present utility model, the two magnetic members are oppositely provided to produce a repulsive force by adopting magnetic forces of magnetic stones and magnets, the ornament connected with the magnetic member can be suspended in the space between the transparent bottom cover and the top cover without using any mechanical mechanism, and thereby the suspension effect is achieved. Besides, for different ornaments, different magnetic stone combinations need to be adjusted again and used.

It needs to be noted that the most important cause that the product provided by the present utility mode can achieve the effect of suspension in the space is the principle that like magnetic poles repel each other in physics. Thus, the magnetic force of the magnetic stones and the magnets should be set according to the actual needs, so as to realize a stable suspension effect. Therefore, for example, when the product provided by the present utility model is placed in an electric field, the ornament is skewed. However, after the product is far away from the electric field, the suspension effect can be restored immediately. It needs to be further noted that the product provided by the present utility model is only suitable for pendants or earrings which are vertically put on, and cannot be used for products such as finger rings.

The ornament assembly with the suspension effect provided by the present utility model has the waterproof effect, the ornament can be prevented from being eroded by water mist and the service life of the ornament is prolonged.

The ornament assembly with the suspension effect provided by the present utility model is unique in creativity, the entire product structure is not complex and the ornament assembly can be easily accepted by the public.

Finally, it needs to be emphasized that the above-mentioned embodiments are just preferred embodiments of the present utility model and are not used for limiting the present utility model. For one skilled in the art, the present utility model may have various changes and modifications. Any modification, equivalent replacement, improvement and the like made within the spirit and rule of the present utility model shall be all included in the protection scope of the present utility model.

The invention claimed is:

1. An ornament assembly with a suspension effect, comprising:

a base comprising a bottom frame and a transparent bottom cover, wherein the transparent bottom cover is fixed on the bottom frame;

a top frame fit and combined with the base to form an integral body, wherein a transparent top cover is fixed on the top frame and the top cover is fit with the transparent bottom cover to form a holding space;

a first magnetic member provided on the base; and an ornament, wherein a second magnetic member is provided on the ornament, the ornament is provided in the holding space and magnetic poles of the first magnetic member and the second magnetic member are oppositely arranged such that the ornament is suspended in the holding space under the repulsive force of magnetic forces.

2. The ornament assembly with the suspension effect according to claim 1, wherein the bottom frame comprises:

a bottom outer frame; and a bottom inner frame provided in the bottom outer frame and combined with the bottom outer frame.

3. The ornament assembly with the suspension effect according to claim 1, wherein the first magnetic member is provided at one end of the bottom frame.

4. The ornament assembly with the suspension effect according to claim 3, wherein the first magnetic member is configured to account for 40-60% of a circumference of the entire bottom frame.

5. The ornament assembly with the suspension effect according to claim 1, wherein the top frame comprises a top outer frame and a top inner frame which are mutually combined.

6. The ornament assembly with the suspension effect according to claim 1, wherein the transparent bottom cover and the transparent top cover are made of crystal glass, wherein a thickness of the transparent bottom cover is 1-2 mm and a thickness of the transparent top cover is 1-2 mm.

7. The ornament assembly with the suspension effect according to claim 1, wherein the first magnetic member and the second magnetic member are magnetic material or magnets.

* * * * *